US006397903B1

(12) United States Patent
Coates, III et al.

(10) Patent No.: US 6,397,903 B1
(45) Date of Patent: Jun. 4, 2002

(54) PRESSURE MONITORING DEVICE FOR VAPOR RECOVERY FOR FUEL DISPENSING SYSTEM

(75) Inventors: Gordon R. Coates, III, St. Charles; Arthur C. Fink, Jr., Franklin, both of MO (US)

(73) Assignee: Krosky Corporation, Pacific, MO (US)

( * ) Notice: Subject to any disclaimer, the term of this patent is extended or adjusted under 35 U.S.C. 154(b) by 0 days.

(21) Appl. No.: 09/668,582

(22) Filed: Sep. 25, 2000

(51) Int. Cl.[7] ..... B65B 1/04

(52) U.S. Cl. ..... 141/94; 141/95; 141/59; 141/392

(58) Field of Search ..... 141/83, 94, 95, 141/59, 392; 73/861.85, 204.22

(56) References Cited

U.S. PATENT DOCUMENTS

| | | | | |
|---|---|---|---|---|
| 4,016,910 A | | 4/1977 | Dumpis et al. | |
| 4,031,930 A | | 6/1977 | Sutcliffe et al. | |
| 4,199,012 A | | 4/1980 | Lasater | |
| 4,223,706 A | | 9/1980 | McGahey | |
| 4,232,715 A | | 11/1980 | Pyle | |
| 4,351,375 A | | 9/1982 | Polson | |
| 4,429,725 A | | 2/1984 | Walker et al. | |
| 5,197,523 A | | 3/1993 | Fink, Jr. et al. | |
| 5,476,125 A | | 12/1995 | Mitchell | |
| 5,522,440 A | | 6/1996 | Mitchell | |
| 5,913,344 A | * | 6/1999 | Wronski et al. | 141/83 |
| 6,170,539 B1 | * | 1/2001 | Pope et al. | 141/59 |

* cited by examiner

*Primary Examiner*—Steven O. Douglas
(74) *Attorney, Agent, or Firm*—Paul M Denk

(57) ABSTRACT

Apparatus and method for monitoring pressure within a vapor recovery pathway of a vapor recovery fuel system including pressure transducer linked to a radio frequency (RF) transponder. The pressure transducer detects changes in vapor pressure within a vapor recovery pathway pressure and the RF transponder relays the information to a remote site for monitoring. The radio frecuency transponder can be housed within as spacer between the vapor recovery hose and the nozzle, mounted in the nozzle itself, the fuel delivery hose, or externally to any of these elements. The detected changes in vapor line pressure can be relayed to any of the fuel dispenser to actuate adjustments in the dispensing system such as vapor recovery pump speed or other parameters.

20 Claims, 3 Drawing Sheets

PRESSURE MONITORING DEVICE FOR VAPOR RECOVERY FOR FUEL DISPENSING SYSTEM

CROSS REFERENCE TO RELATED APPLICATIONS

None

STATEMENT REGARDING FEDERALLY SPONSORED RESEARCH OR DEVELOPMENT

Not applicable

BACKGROUND OF THE INVENTION

The invention relates generally to fuel dispensing systems used to dispense gasoline for automobiles and the like and, more particularly, to an apparatus for measuring the pressure within a vapor recovery pathway in a fuel dispensing system.

Gasoline dispensing systems, including a storage tank, pump, hose and nozzle are known to the art. The nozzles found most in gasoline or service stations include a spout which is insertable into the inlet of the filler pipe of an automobile fuel tank or other storage receptacle.

As a result of various environmental regulations, many jurisdictions require that fuel dispensing systems be designed so that fuel vapors are captured and not allowed to escape into the atmosphere. Some nozzles are equipped with flexible bellows that fit over the spout and fit snugly against the opening of the filler pipe sealing the delivery of the fuel against the escape of vapors. For example, U.S. Pat. No. 4,031,930 and No. 4,016,910, assigned to the Husky Corporation, the same assignee as the present application, disclose and claim such vapor recovery systems. Other systems includes those disclosed in U.S. Pat. No. 4,429,725 to Walker; U.S. Pat. No. 4,351,375 to Polson; U.S. Pat. No. 4,232,715 to Pyle; U.S. Pat. No. 4,223,706 to McGahey; and U.S. Pat. No. 4,199,012 to Lasater.

The assignee of this application owns several patents which disclose vapor recovery systems which provide improvements over the above-listed art. For example, U.S. Pat. No. 5,197,523 provides a improved nozzle assembly by which fuel which condenses in a vapor return hose of the nozzle assembly can be extracted and returned to the fuel reservoir to help reduce atmospheric pollution. U.S. Pat. No. 5,476,125 provides a nozzle which incorporates a vapor recovery system having a fuel flow path and a vapor recovery path. U.S. Pat. No. 5,522,440 discloses a vapor recovery spout gland which is used to secure a vapor guard to the spout used with a nozzle having a body fuel flow path and a vapor recovery path.

Although the assignee's prior nozzle designs work well for their intended purposes, it is difficult, short of absolute nozzle failure, to determine whether the vapor recovery aspect of the inventions are functioning at peak efficiency due to blockage of the vapor recovery path. It would be advantageous, therefore, to have a monitoring system that can determine system conditions during use.

SUMMARY OF THE INVENTION

It is among the invention to provide a monitoring apparatus to determine system conditions within a fuel dispensing system including a vapor recovery path.

Another object of the invention is to provide such a system that monitors vapor recovery pathway pressure during use.

It is another object of the invention is to provide such a system that monitors vapor recovery pathway pressure and transfer the information to the fuel dispenser.

Yet another object of the invention is to provide such a system that monitors vapor recovery pathway pressure and transfer the information to the fuel dispenser to control fuel dispenser functions.

Still another object of the invention is to provide such a system that monitors vapor recovery pathway pressure to transfer the information to the fuel dispenser and generate a signal to drain fuel from the vapor recovery pathway.

Another object of the invention is to provide such a system that monitors vapor recovery pathway pressure use that information to maintain proper storage tank pressure.

In accordance with the invention, generally stated, an apparatus and method for monitoring pressure within a vapor recovery pathway of a vapor recovery fuel system, The apparatus includes a pressure transducer linked to a radio frequency (RF) transponder. The transducer detects changes in vapor recovery pathway pressure and the RF transponder can relay the information to a remote site, such as the dispenser, for monitoring and control of dispenser functions. The radio frequency transponder can be housed within as spacer between the vapor recovery hose and the nozzle which can be constructed as a hose-to-nozzle break away fitting. Alternatively, the transducer can be mounted in the nozzle itself, the fuel delivery hose, or externally to any of these elements. For a balanced vapor recovery system, the invention is located between the dispensing nozzle vapor valve and the location at which vapor line return blockage is most prevalent, i.e. the lowest point in the hose. For a vacuum assist vapor recovery system, the invention can be located in the prior stated locations or inside the dispenser (gas pump) itself The present invention allows active monitoring of pressures to detect vapor line blockage or other malfunctions. The invention then relays the detected information to the dispenser, for example, to allow monitoring of proper dispenser operation and to adjust operations parameters. The device monitors vapor recovery pathway pressure during refueling and transfer the information to the dispenser. The dispenser then utilizes the information to determine system conditions such as system failure, ORVR refueling, nozzle shutoff, and so on. The information can be utilized by the dispenser to control operations parameters, for example, vapor recovery pump speed to maintain the proper underground storage pressure or fuel drainage from the dispensing hose.

BRIEF DESCRIPTION OF THE DRAWINGS

Corresponding reference numerals indicate corresponding elements and structures throughout the various drawings.

DETAILED DESCRIPTION OF THE INVENTION

Figure 1:
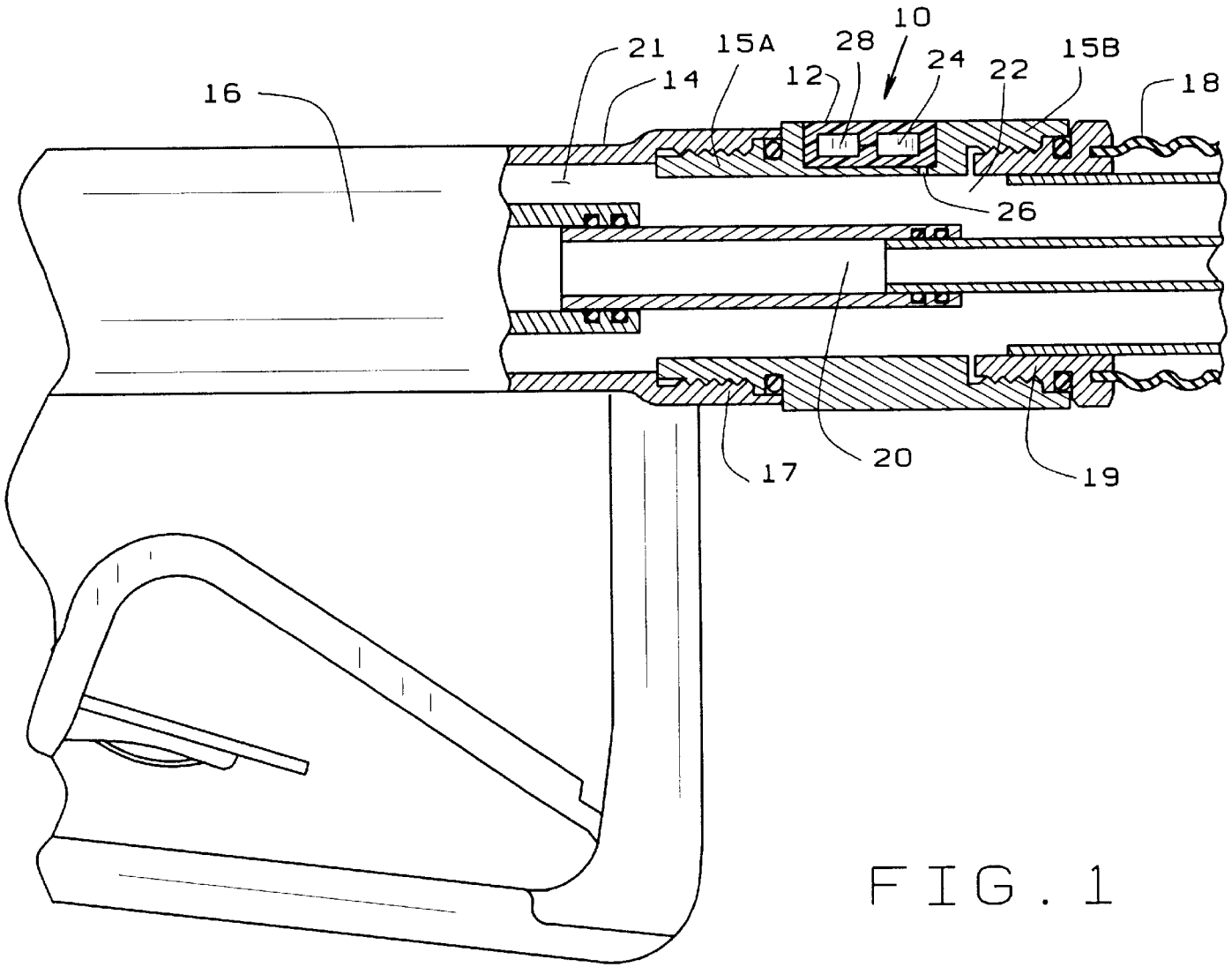
FIG. 1 is a cross sectional, side elevational view of the pressure monitor of the present invention housed in a spacer positioned between a fuel dispensing nozzle and a fuel dispensing hose.

The apparatus for monitoring and also controlling the vapor pressure within a vapor recovery pathway of a fuel dispensing system is indicated generally be reference number 10 in the drawings. As will be appreciated by those skilled in the art, the intended environment for the instant invention is a conventional fuel dispensing system having fuel vapor recovery capabilities when fuel is being dispensed through the system. At a minimum, such a system will include a bulk storage tank, generally under ground, a fuel dispenser commonly referred to as a gas pump, a vapor recovery pump, a fuel dispensing hose operatively associated with the fuel dispenser, and a fuel dispensing nozzle on the terminal end of the hose to control the dispensing of the fuel into the filltube of an automobile gas tank or other receptacle. This type of system generally includes a vapor recovery pathway way that extends from the spout of the fuel dispensing nozzle, through the hose and the fuel dispenser and communicating with the storage tank. The vapor recovery pump facilitates the capture of fuel vapors during dispensing and draws the vapors into the storage tank. Actuation of vapor recovery pump generally is dependent upon the vapor pressure in the receptacle receiving fuel, the vapor pressure within the vapor recovery pathway and the vapor pressure within the storage tank. With regard to the present invention, and the appended claims, the term "actuation" of the vapor recovery pump is intended to include starting the pump, increasing the speed of the pumping action, slowing down the speed of the pumping action or stopping the pump, unless otherwise indicated.

Apparatus 10, as shown in FIG. 1, includes a housing 12 which is internal to a connector or spacer 14. The spacer 14 is a substantially cylindrical tube having and externally threaded coupling 15A at the fore end and an internally threaded coupling 15B at the aft end. In the illustrated arrangement, spacer 14 is connected between a vapor recovery fuel dispensing nozzle 16 via the nozzle's internally threaded coupling 17 and the output end of a fuel dispensing hose 18 via the hose's externally coupling 19. Spacer 14 has an internal bore containing an concentric fuel flow tube 20.

Figure 2:
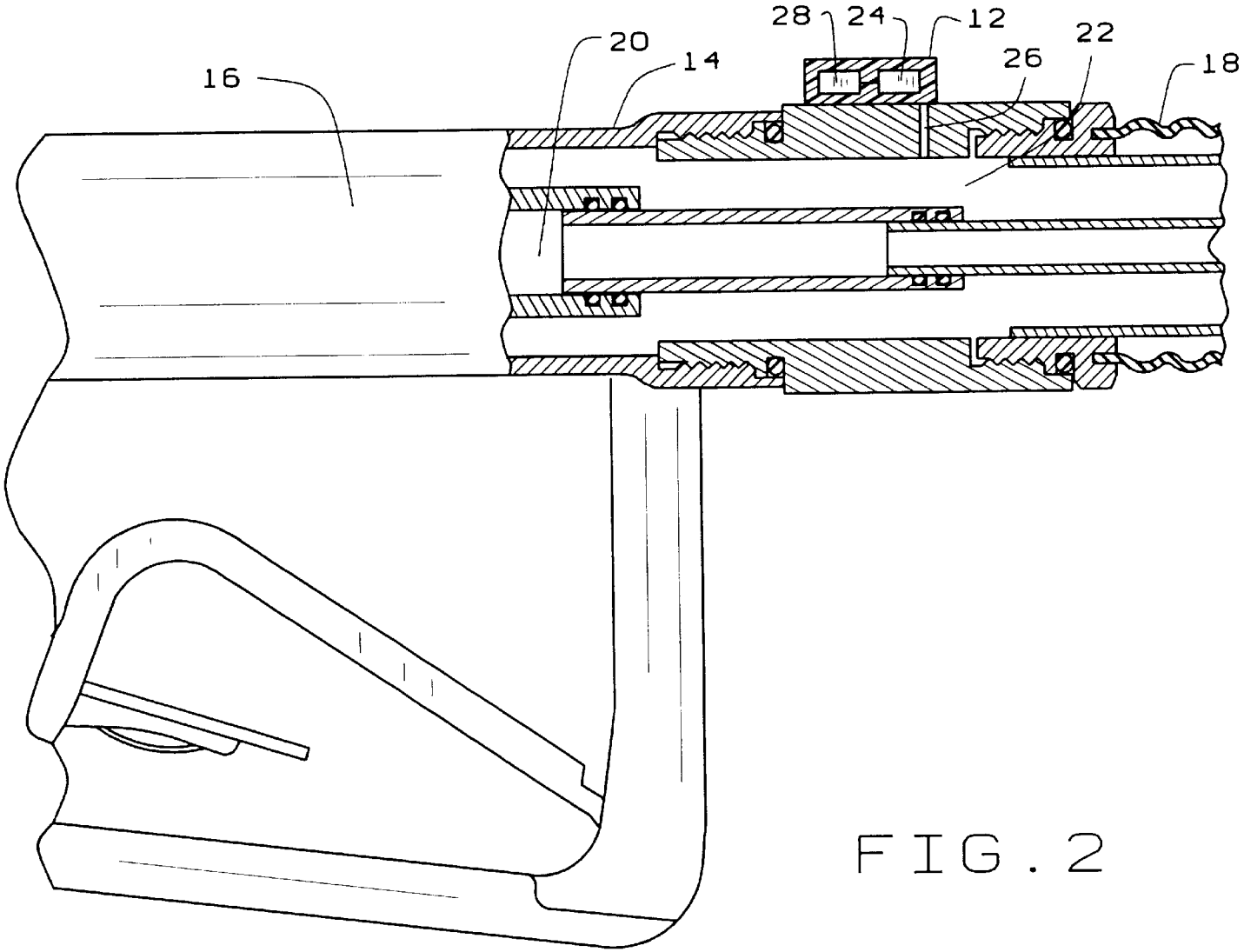
FIG. 2 is a cross sectional, side elevational view of the pressure monitor of the present invention mounted externally to a spacer positioned between a fuel dispensing nozzle and a fuel dispensing hose.
Figure 3:
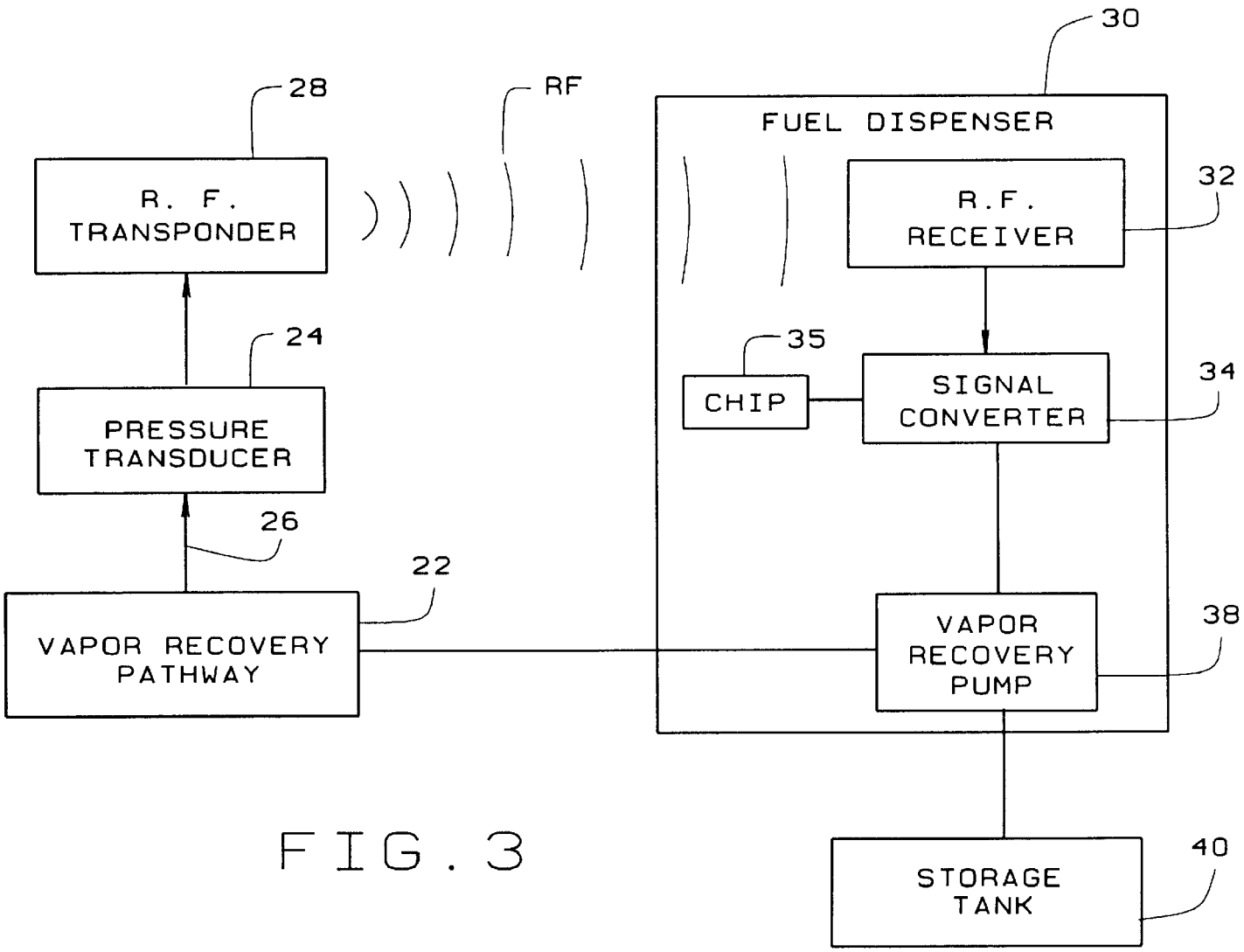
FIG. 3 is a schematic illustrating the apparatus and method of the present invention.

In FIG. 2, the housing 12 is located externally to the spacer 14 only to illustrate that the apparatus of the present invention can be located at any convenient and function position in the fuel dispensing system. For what is known in the art as a balanced vapor recovery system, the apparatus 10 is to be located between the nozzle 16 internal vapor pathway 21 and the location at which vapor pathway blockage is most prevalent, that is, the lowest point in hose 18. By being associated with the spacer 14, the apparatus is between the nozzle and the hose. It will be appreciated that FIGS. 1 and 2 are illustrative and that the housing 12 of the apparatus can be incorporated into nozzle 16. For a vacuum assist vapor recovery system, the apparatus can be located in the spacer 14, as shown, in the nozzle 16 or within the dispenser (FIG. 3). In any event, the vapor recovery system illustrated includes a vapor recovery pathway, indicated generally by reference number 22. As can be seen, the vapor recovery pathway 22 is contiguous through the hose 18, the spacer 14 and the nozzle 16. Concentric to the vapor recovery pathway 22 is the fuel delivery passage 24, which is also contiguous and extends through the hose, spacer and nozzle. Both recited pathways extend through the fuel dispenser and open into the fuel storage tank. (FIG. 3).

Returning now to apparatus 10, internal to the illustrated housing 12 is a pressure transducer 24. Pressure transducer 24 is in fluid communication with the vapor recovery pathway 22 via pressure tap 26 and capable of reading the internal vapor pressure of the vapor recovery pathway 22 and transmitting that vapor pressure as a signal. The apparatus also includes a radio frequency (RF) transponder 28 in operative communication with the pressure transducer 24. The RF transponder 28 receives the pressure signal from the pressure transducer 24 and converts it to a radio frequency signal.

As shown in FIG. 3, the apparatus functions to monitor vapor pressure within the vapor recovery pathway and transmit that pressure to the dispenser to control dispenser functions, primarily the actuation of the vapor recovery pump to maintain proper underground storage tank pressure. As shown, the pressure transducer 24 is operatively connected to the vapor recovery pathway 22 via tap 26. Transducer 24 receives pressure and transmits the pressure as a signal S to the RF transponder 28. It will be noted that if RF transponder 28 is an active transponder, a power supply (not shown) is required. The RF transponder converts the signal S to a radio frequency signal RF which is transmitted to the dispenser 30 which houses a radio receiver 32. The radio receiver 32 is operatively connected to a signal converter 34 (or a programmable chip 35) to adjust or control dispenser functions. Examples of monitoring and adjustment are detecting system failures, ORVR refueling, nozzle shutoff, etc. that may require change or shutoff of dispenser fuel pump activity. For example, if there is excess fuel in a balanced vapor return hose, refueling of a conventional automobile will show an increase in vapor pressure. The RF signal can be processed and generate a code to drain fuel out of the vapor recovery pathway. Or, by way of an illustrated example, if an ORVR equipped vehicle is refueling on a vacuum assist vapor recovery system, the pressure in the vapor recovery pathway will be different than a non-ORVR vehicle. The signal converter 34 sends an actuation signal 36 to the vapor recovery pump 38, which is operatively connected to the fuel storage tank 40, for actuation to maintain proper vapor pressure within the fuel storage tank 40.

It will be appreciated from the drawings that the novel monitoring apparatus is contained adjacent the nozzle or in the nozzle itself and transmits a signal by radio waves to control the vapor recovery tank. The monitored vapor pressure within the vapor recovery pathway is directly related to the underground storage tank pressure and is used to monitor and maintain proper vapor pressure in the storage tank. As stated above, proper vapor pressure is maintained by sending an actuation signal based on the monitored pressure which can actuate or turn on the vapor recovery pump, turn off the pump, speed up or slow down the pump.

As will be appreciated, other dispenser functions can be controlled by the RF receiver and appropriate signal converter or preprogrammed chip 35 based upon the monitored vapor pressure without departing from the scope of the appended claims. Therefore, the foregoing description and accompanying drawings are intended to be illustrative only and should not be construed in a limiting sense.

What is claimed is:

1. An apparatus for monitoring pressure within a vapor recovery pathway of a fuel dispensing system having a fuel source, a fuel dispenser, a fuel dispensing hose and a dispensing nozzle, the apparatus comprising:

a pressure transducer in communication with the vapor recovery pathway, said transducer capable of receiving a vapor pressure from the vapor recovery pathway and sending said pressure as a pressure signal;

a radio frequency transponder associated with said pressure transducer, said radio frequency transponder capable of receiving said pressure signal from said pressure transducer and transmitting said pressure signal as a radio signal; and a receiver operatively associated with the fuel dispenser to receive said pressure radio signal from said radio frequency transponder.

2. The apparatus of claim 1 wherein said receiver also is operatively associated with a vapor recovery pump within said fuel dispenser.

3. The apparatus of claim 2 further wherein said vapor recovery pump is capable of actuation in response to a signal from said receiver.

4. The apparatus of claim 1 wherein said receiver also is operatively associated with a processor within said fuel dispenser, said processor programmed to convert the radio frequency signal into a code to control a dispenser function.

5. The apparatus of claim 1 wherein said transponder receives said pressure and transmits said pressure as a radio frequency signal.

6. The apparatus of claim 1 wherein the fuel dispensing system is a balanced vapor recovery system and the transducer is located between the dispensing nozzle and a low point in the fuel dispensing hose.

7. The apparatus of claim 1 wherein the fuel dispensing system is a vacuum assist vapor recovery system and the apparatus is located in the fuel dispenser.

8. The apparatus of claim 1 wherein said receiver is operatively connected to the fuel dispenser so as to actuate fuel dispenser functions in response to said pressure signal.

9. The apparatus of claim 1 wherein said transducer and said transponder are located in a spacer between the fuel dispensing nozzle and the fuel dispensing hose.

10. A method of monitoring and controlling a fuel dispenser function of a vapor recovery fuel dispensing system having a fuel storage tank, a fuel dispenser, a fuel dispensing hose, a fuel dispensing nozzle, and a vapor recovery pathway, the method comprising:

receiving a vapor pressure from within the vapor recovery pathway through a pressure transducer;

converting the received vapor pressure to a vapor pressure signal;

transmitting the vapor pressure signal to a radio frequency transponder;

sending the vapor pressure as a radio frequency signal from the transponder to a receiver associated with the fuel dispenser; and actuating a dispenser function based upon the vapor pressure radio frequency.

11. The method of claim 10 wherein the fuel dispenser function is the actuation of a vapor recovery pump within the fuel dispenser.

12. The method of claim 11 further including a step of said receiver sending a signal to said vapor recovery pump and actuating said vapor recovery pump in response to the received radio frequency vapor pressure signal.

13. The method of claim 12 wherein said step of actuating said vapor recovery pump further comprises starting said vapor recovery pump.

14. The method of claim 12 wherein said actuating said vapor recovery pump further comprises stopping said vapor recovery pump.

15. The method of claim 12 wherein said actuating said vapor recovery pump further comprises speeding up said vapor recovery pump.

16. The method of claim 12 wherein said actuating said vapor recovery pump further comprises slowing down said vapor recovery pump.

17. The method of claim 10 wherein the step of actuating a fuel dispenser function based upon the vapor pressure radio frequency further comprises draining fuel from the fuel dispensing hose.

18. The method of claim 17 wherein the step of actuating a fuel dispenser function based upon the vapor pressure radio frequency further comprises draining fuel from the vapor recovery pathway of the fuel dispensing hose.

19. The method of claim 10 wherein the step of actuating a fuel dispenser function based upon the vapor pressure radio frequency further comprises shutting off the fuel dispenser to halt a flow of fuel.

20. The method of claim 10 wherein the step of actuating a dispenser function based upon the vapor pressure radio frequency further comprises draining fuel from the vapor recovery pathway.

* * * * *

UNITED STATES PATENT AND TRADEMARK OFFICE

CERTIFICATE OF CORRECTION

PATENT NO. : 6,397,903 B1 
DATED : June 4, 2002
INVENTOR(S) : Gordon R. Coates, III and Arthur C. Fink, Jr.

It is certified that error appears in the above-identified patent and that said Letters Patent is hereby corrected as shown below:

Title page,
Item [73], change "Krosky" to -- Husky --

Signed and Sealed this

Eighth Day of October, 2002

*Attest:*

*Attesting Officer*

JAMES E. ROGAN
*Director of the United States Patent and Trademark Office*